US012426636B2

(12) United States Patent
Liu et al.

(10) Patent No.: US 12,426,636 B2
(45) Date of Patent: Sep. 30, 2025

(54) E-CIGARETTE VAPORIZER AND E-CIGARETTE THAT CAN COLLECT AND HOLD CONDENSATE FROM AEROSOL

(71) Applicant: SHENZHEN FIRST UNION TECHNOLOGY CO., LTD., Shenzhen (CN)

(72) Inventors: Yongqiang Liu, Shenzhen (CN); Linhai Lu, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 380 days.

(21) Appl. No.: 18/009,722

(22) PCT Filed: Jun. 10, 2021

(86) PCT No.: PCT/CN2021/099415
§ 371 (c)(1),
(2) Date: Dec. 10, 2022

(87) PCT Pub. No.: WO2021/249488
PCT Pub. Date: Dec. 16, 2021

(65) Prior Publication Data

US 2023/0218005 A1 Jul. 13, 2023

(30) Foreign Application Priority Data

Jun. 10, 2020 (CN) ..... 202021053169.0

(51) Int. Cl.
*A24F 40/48* (2020.01)
*A24F 40/10* (2020.01)
(Continued)

(52) U.S. Cl.
CPC ..... *A24F 40/48* (2020.01); *A24F 40/10* (2020.01); *A24F 40/42* (2020.01); *A24F 40/44* (2020.01)

(58) Field of Classification Search
CPC ..... A24F 40/48; A24F 40/44; A24F 40/42; A24F 40/10
See application file for complete search history.

(56) References Cited

U.S. PATENT DOCUMENTS 11,382,354 B2 * 7/2022 Chen ..... A24F 40/50
2020/0113243 A1 4/2020 Novak, III
(Continued)

FOREIGN PATENT DOCUMENTS

CN 206808661 U 12/2017
CN 110613172 A 12/2019
(Continued)

*Primary Examiner* — Hae Moon Hyeon
(74) *Attorney, Agent, or Firm* — Cheng-Ju Chiang

(57) ABSTRACT

This application provides an e-cigarette vaporizer and an e-cigarette. The e-cigarette vaporizer includes an outer housing including an open end and an end cap arranged at the open end, where a liquid storage cavity and a sealing base configured to seal the liquid storage cavity are provided in the outer housing; a sealing ring is arranged between the end cap and the outer housing; a vaporization cavity is provided between the sealing ring and the sealing base, and the liquid substrate is vaporized in the vaporization cavity to generate aerosol released to the vaporization cavity; and a plurality of liquid storage grooves configured to adsorb and hold aerosol condensate are provided in the vaporization cavity. The e-cigarette vaporizer uses the liquid storage groove for absorbing the condensate through the capillary action, and prevents the condensate from being taken out along with inhaling airflow during inhaling.

19 Claims, 6 Drawing Sheets

(51) Int. Cl.
*A24F 40/42* (2020.01)
*A24F 40/44* (2020.01)

(56) References Cited

U.S. PATENT DOCUMENTS

| | | | | |
|---|---|---|---|---|
| 2022/0211107 | A1* | 7/2022 | Zhang | A24F 40/44 |
| 2024/0081417 | A1* | 3/2024 | Xie | A61M 15/06 |

FOREIGN PATENT DOCUMENTS

| | | | |
|---|---|---|---|
| CN | 209825214 | U | 12/2019 |
| CN | 110638102 | A | 1/2020 |
| CN | 210203317 | U | 3/2020 |
| CN | 210203366 | U | 3/2020 |
| CN | 210203369 | U | 3/2020 |
| CN | 213344343 | U | 6/2021 |

* cited by examiner

E-CIGARETTE VAPORIZER AND E-CIGARETTE THAT CAN COLLECT AND HOLD CONDENSATE FROM AEROSOL

CROSS-REFERENCE TO RELATED APPLICATIONS

This application is a 35 U.S.C. § 371 National Phase conversion of International (PCT) Patent Application No. PCT/CN2021/099415, filed on Jun. 10, 2021, which claims priority to Chinese Patent Application No. 202021053169.0, entitled "E-CIGARETTE VAPORIZER AND E-CIGARETTE" and filed with the China National Intellectual Property Administration on Jun. 10, 2020, which is incorporated herein by reference in its entirety. The PCT International Patent Application was filed and published in Chinese.

TECHNICAL FIELD

Embodiments of this application relate to the field of electronic cigarette (e-cigarette) technologies, and in particular, to an e-cigarette vaporizer and an e-cigarette.

BACKGROUND

E-cigarette is a product in which nicotine-containing e-liquid is heated and vaporized into aerosol for users to inhale. For example, FIG. 1 shows an example of the existing e-cigarette product, which generally includes a vaporizer 1 and a power supply 2. The power supply 2 supplies power to the vaporizer 1 through a pogo pin 3 arranged on the power supply 2. The vaporizer 1 is a device for implementing a vaporization function of e-liquid, and a structure thereof includes a liquid storage cavity configured to store the e-liquid, a porous body for absorbing the e-liquid from the liquid storage cavity, and a heating body for heating and vaporizing the e-liquid absorbed by the porous body. Further, in order to form aerosol transmission during an inhaling process by a user, an air inlet hole for air inlet is provided on a part corresponding to the heating body on a shell of the vaporizer, and a vapor-gas transmission pipe in the vaporizer for outputting the aerosol. In a process of inhaling by a user, external air enters the vaporizer from the air inlet hole, and then is outputted through the vapor-gas transmission pipe accompanied by the aerosol, to form a complete airflow circulation.

Due to arrangement of an airflow circulation structure, during use of the vaporizer 1, the aerosol formed by heating in a vaporization cavity is cooled during transmission to form condensate, and the condensate will be sent to a suction nozzle along with inhaling airflow after accumulated inside the vaporization cavity and inhaled by the user, which affects inhaling experience.

SUMMARY

In order to solve a problem that, in an e-cigarette in the related art, condensate is easy to be inhaled, embodiments of this application provide an e-cigarette vaporizer and an e-cigarette that can collect and hold the condensate and further prevent the condensate from being taken out along with inhaling airflow.

This application provides an e-cigarette vaporizer. The e-cigarette vaporizer includes: an outer housing including an open end and an end cap arranged at the open end, where a liquid storage cavity configured to store a liquid substrate and a sealing base configured to seal the liquid storage cavity are provided in the outer housing;

a sealing ring is arranged between the end cap and the outer housing;

a vaporization cavity is provided between the sealing ring and the sealing base, and the liquid substrate is vaporized in the vaporization cavity to generate aerosol released to the vaporization cavity; and a plurality of liquid storage grooves configured to adsorb and hold aerosol condensate through capillary action are provided on a wall defining the vaporization cavity.

In a preferred embodiment, a width of the liquid storage groove is between 0.05 mm and 0.2 mm.

In a preferred embodiment, a plurality of the liquid storage grooves are discretely provided without intersecting or connecting with each other.

In a preferred embodiment, the liquid storage groove includes a first liquid storage groove provided on a surface of the end cap opposite to or facing away from an inner wall of the outer housing.

In a preferred embodiment, a heating element configured to vaporize the liquid substrate to generate the aerosol and release the aerosol into the vaporization cavity, and a porous body configured to transmit the liquid substrate of the liquid storage cavity to the heating element are arranged in the vaporization cavity.

A support frame configured to accommodate and hold the porous body is further arranged in the vaporization cavity, and the sealing base at least partially surrounds the support frame.

A support arm configured to provide support to the support frame is arranged at the end cap, and the first liquid storage groove at least partially extends on a surface of the support arm.

In a preferred embodiment, a heating element configured to vaporize the liquid substrate to generate the aerosol and release the aerosol into the vaporization cavity, and a porous body configured to transmit the liquid substrate of the liquid storage cavity to the heating element are arranged in the vaporization cavity.

A support frame configured to accommodate and hold the porous body is further arranged in the vaporization cavity, and the sealing base at least partially surrounds the support frame. The liquid storage groove includes a second liquid storage groove formed on a surface of the support frame facing an inner wall of the outer housing.

In a preferred embodiment, the second liquid storage groove is constructed to be provided obliquely in a direction close to the sealing base.

In a preferred embodiment, a vapor-gas output channel is further arranged in the outer housing, and the vapor-gas output channel is at least partially located on the surface of the support frame facing the inner wall of the outer housing; and the second liquid storage groove is constructed to be arranged at both sides of the vapor-gas output channel in a width direction of the outer housing.

In a preferred embodiment, the second liquid storage groove includes a first portion extending in a circumferential direction of the support frame and a second portion in communication with the first portion in a longitudinal direction of the support frame.

In a preferred embodiment, the second portions are separated from each other in the longitudinal direction of the support frame.

In a preferred embodiment, the liquid storage groove is in airflow communication with the vapor-gas output channel.

In a preferred embodiment, non-airflow communication is maintained between the liquid storage groove and the liquid storage cavity.

This application further provides an e-cigarette. The e-cigarette includes a vaporizing device for vaporizing a liquid substrate to generate aerosol, and a power supply device for supplying power to the vaporizing device. The vaporizing device includes the foregoing e-cigarette vaporizer.

The e-cigarette vaporizer uses the liquid storage groove for absorbing the condensate through the capillary action, and prevents the condensate from being taken out along with inhaling airflow during inhaling by keeping the condensate in the liquid storage groove, thus eliminating a problem of inhaling the condensate.

BRIEF DESCRIPTION OF THE DRAWINGS

One or more embodiments are exemplarily described with reference to the corresponding figures in the accompanying drawings, and the descriptions are not to be construed as limiting the embodiments. Elements in the accompanying drawings that have same reference numerals are represented as similar elements, and unless otherwise particularly stated, the figures in the accompanying drawings are not drawn to scale.

DETAILED DESCRIPTION

For ease of understanding of this application, this application is described below in more detail with reference to accompanying drawings and specific implementations.

Figure 1:
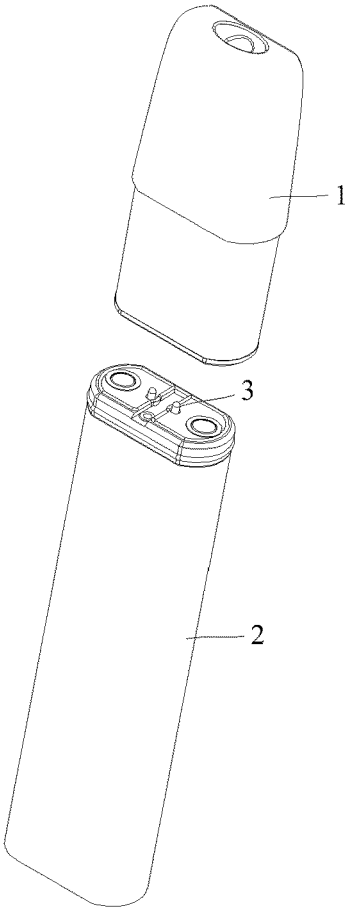
FIG. 1 (Prior Art)
FIG. 1 is a schematic diagram of the existing e-cigarette product.
Figure 2:
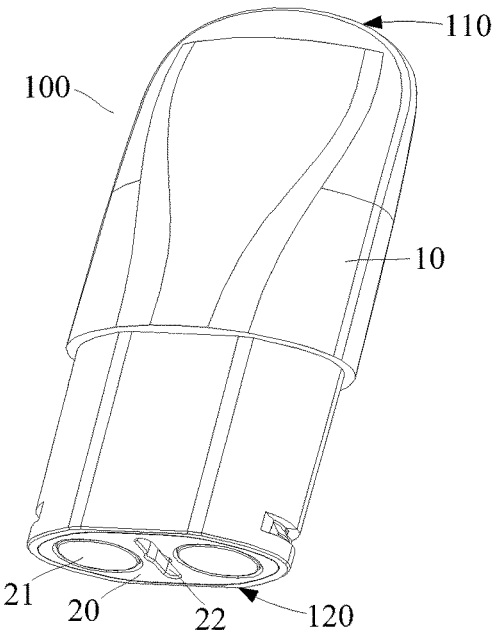
FIG. 2 is a schematic structural diagram of a vaporizer according to an embodiment.

Embodiments of this application provide an electronic cigarette (e-cigarette) product for heating and vaporizing a liquid substrate. In an embodiment, a common vaporizer of a flat cigarette shown in FIG. 2 is used as an example for description. The vaporizer can heat and vaporize an internally stored liquid substrate under power supply of a power supply device 2 shown in FIG. 1 to generate aerosol for inhaling.

Specifically, in the embodiment shown in FIG. 2, a vaporizer 100 includes a hollow cylindrical outer housing 10, and the outer housing 10 includes a near end 110 and a far end 120 that are opposite in a length direction. According to a requirement of common use, the near end 110 is configured as an end for a user to inhale the aerosol and a suction nozzle A for the user to inhale is arranged at the near end 110. The far end 120 is used as an end combined with the power supply device, and the far end 120 of the outer housing 10 is open, on which a detachable end cap 20 is mounted. An open structure is used for mounting various necessary functional components inside the outer housing 10.

Further, in the embodiment shown in FIG. 2, an electrode column 21 configured to be in conductive connection with the power supply device, and an air inlet hole 22 for outside air to enter the vaporizer 100 during inhaling are provided on the end cap 20.

Figure 3:
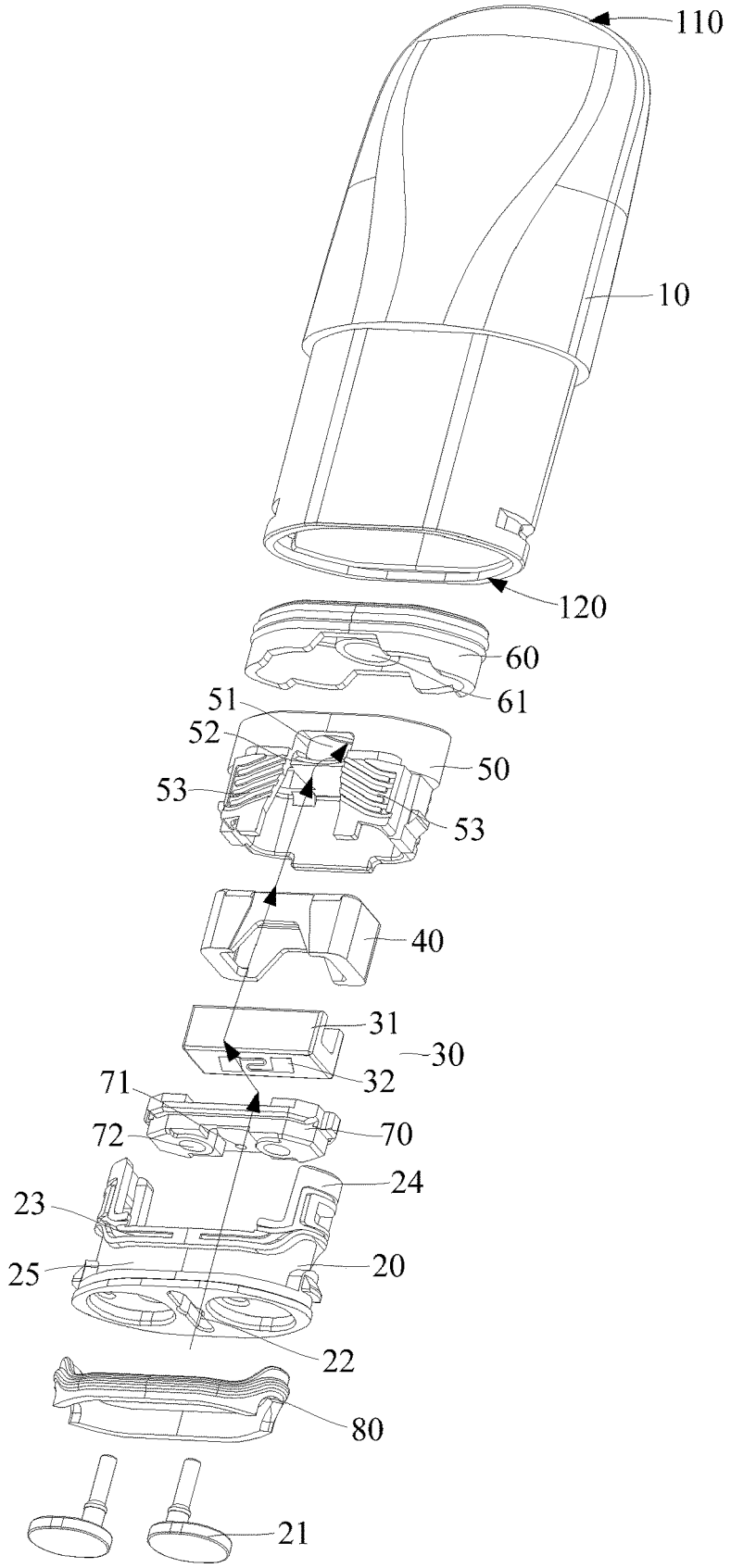
FIG. 3 is a schematic exploded view of the vaporizer in FIG. 2.
Figure 4:
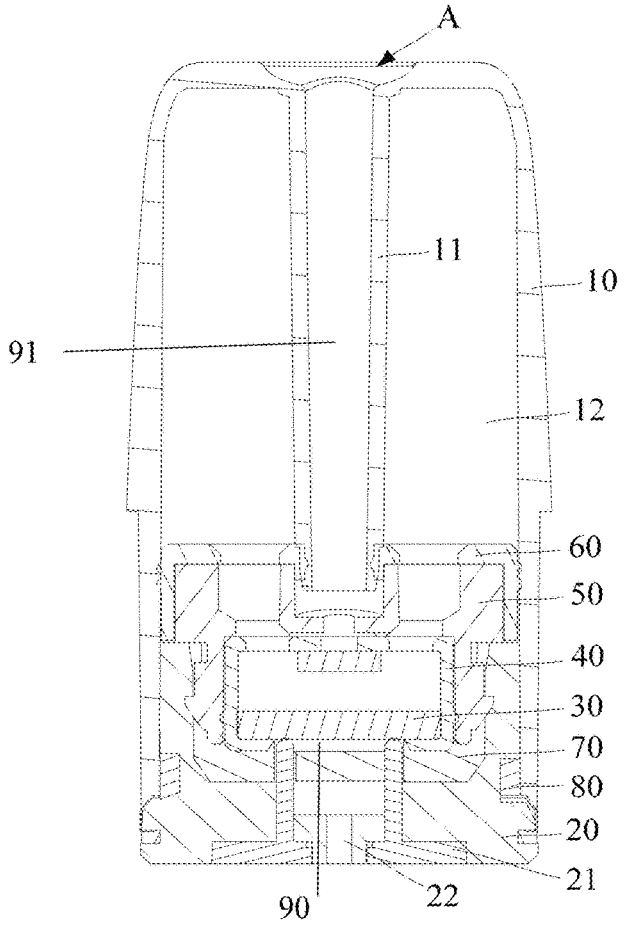
FIG. 4 is a schematic cross-sectional view of the vaporizer in FIG. 2.
Figure 5:
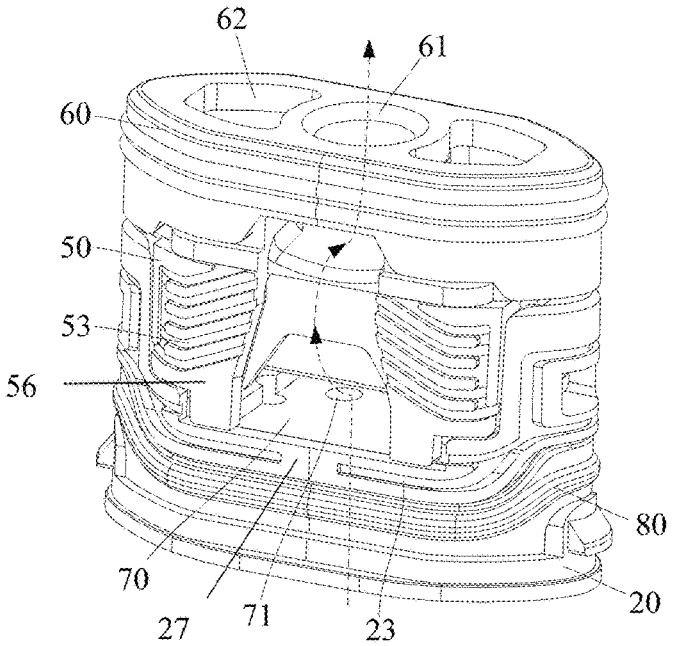
FIG. 5 is a schematic diagram of some components in FIG. 3 after assembly.

Further, as shown in FIG. 3 to FIG. 5, a liquid storage cavity 12 for storing liquid substrate, a porous body 31 of a heater 30 for absorbing the liquid substrate from the liquid storage cavity 12, and a heating element 32 of the heater 30 for heating and vaporizing the liquid substrate absorbed by the porous body 31 are arranged inside the outer housing 10. Specifically, in a cross-sectional structural diagram shown in FIG. 4, a vapor-gas transmission pipe 11 arranged in an axial direction is arranged inside the outer housing 10, and the liquid storage cavity 12 for storing the liquid substrate is formed in a space between an outer wall of the vapor-gas transmission pipe 11 and an inner wall of the outer housing 10. An end of the vapor-gas transmission pipe 11 is in communication with a vapor inhalation opening A, and another end is in communication with airflow in a vaporization cavity 90, thereby outputting generated aerosol to the vapor inhalation opening A for a user to inhale.

Figure 10:
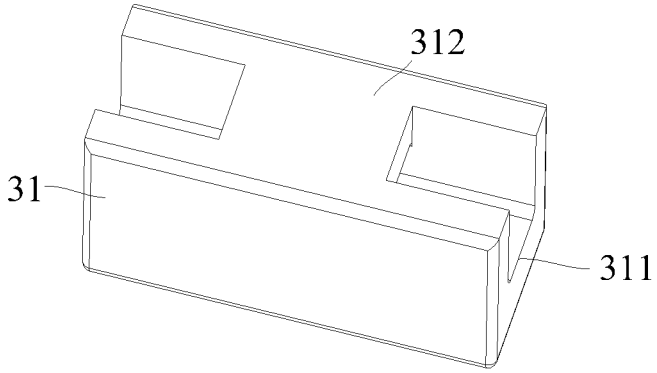
FIG. 10 is a schematic diagram of a porous body in FIG. 3 from another angle of view.

Referring to a structure of the porous body 31 shown in FIG. 3 and FIG. 10, a shape of the porous body 31 is constructed as a substantially arched shape, including a plate-shaped portion 311 and a support portion 312 arranged on the plate-shaped portion 311. An upper surface of the plate-shaped portion 311 is constructed as a liquid absorbing surface. During use, the liquid absorbing surface is in fluid communication with the liquid storage cavity 12, and further can receive liquid substrate flowing out of the liquid storage cavity 12. A lower surface of the plate-shaped portion 311 is constructed as a vaporization surface on which the heating element 32 is arranged. During use, a microporous structure in the porous body 31 conducts liquid substrate absorbed by the liquid absorbing surface to the vaporization surface. The liquid substrate is vaporized by the heating element 32 to form aerosol, and is released and escaped from the vaporization surface.

In a structure of the porous body 31 shown in FIG. 10, because the liquid absorbing surface and the vaporization surface are parallel to each other, moving directions of the liquid substrate and the aerosol in the porous body 31 are both perpendicular to a plane on which the vaporization surface is located. The liquid substrate moves more smoothly in the porous body 31 and is more convenient to manufacture.

In some implementations, the porous body 31 may be made of rigid capillary structures such as porous ceramic, porous glass ceramic, porous glass, and the like. Preferably, the heating element 32 is formed on the vaporization surface by mixing conductive raw material powder and printing auxiliaries into paste and sintering after printing, so that all or most of surface of the heating element 32 is closely bonded with the vaporization surface, and the heating element 32 has effects of high vaporizing efficiency, less heat loss, and preventing or greatly reducing dry burning. In some embodiments, the heating element 32 may be made of stainless steel, nickel-chromium alloy, iron-chromium-aluminum alloy, metallic titanium, and the like.

Further, referring to FIG. 3, FIG. 4, FIG. 6, FIG. 7, FIG. 8, and FIG. 9, in order to assist in mounting and fixing the porous body 31, and sealing the liquid storage cavity 12, a sealing and holding mechanism is further arranged in the outer housing 10, including:

- a silicone sleeve 40, sleeved outside the porous body 31 and supported by a support portion 312 of the porous body 31 to prevent deformation or the like;
- a rigid support frame 50, generally in an annular shape, having a hollow interior for accommodating and holding the porous body 31 on which the silicone sleeve 40 is sleeved, and holding the porous body 31 on which the silicone sleeve 40 is sleeved in the interior in a flexible tight fitting manner; and
- a silicone sealing base 60, arranged at an end portion of the liquid storage cavity 12 facing a far end 120, and a shape of the silicone sealing base 60 matching a cross section of an inner contour of the outer housing 10, so as to seal the liquid storage cavity 12 and prevent the liquid substrate from leaking out of the liquid storage cavity 12. In addition, the silicone sealing base 60 is in a hollow shape and is sleeved outside the rigid support frame 50. Shrinkage and deformation of the silicone sealing base 60 made of a flexible material can be prevented from affecting tightness of seal through support of the rigid support frame 50.

Further, a first liquid guide hole 62 is provided on the silicone sealing base 60, a second liquid guide hole 54 is provided on the rigid support frame 50, and a third liquid guide hole 41 is provided on the silicone sleeve 40. The first liquid guide hole 62, the second liquid guide hole 54, and the third liquid guide hole 41 communicate in sequence to form a flow channel for the liquid substrate in the liquid storage cavity 12 to flow to the liquid absorbing surface.

Further, a first plug-in hole 61 is provided on the silicone sealing base 60, and a second plug-in hole 51 is provided on the rigid support frame 50 for plugging of the vapor-gas transmission pipe 11 in the outer housing 10. In addition, an airflow channel 52 is arranged at a side of the rigid support frame 50 close to a thickness direction, is in airflow communication with the vapor-gas transmission pipe 11, and is further configured to output aerosol in the vaporization cavity 90 to the vapor-gas transmission pipe 11 through the airflow channel 52.

Figure 6:
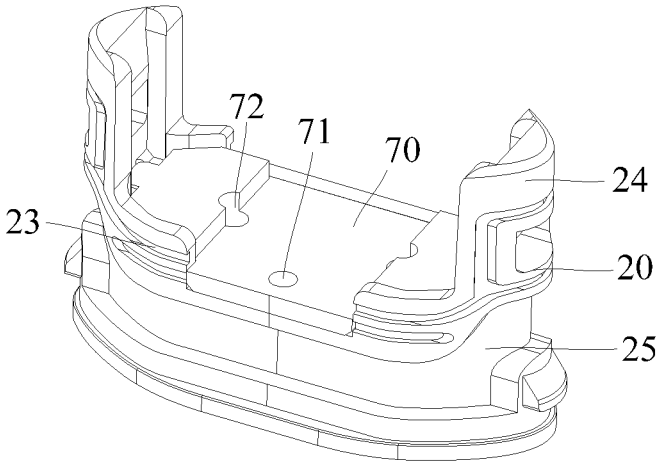
FIG. 6 is a schematic diagram of an end cap on which a separating plate is mounted in FIG. 5.
Figure 7:
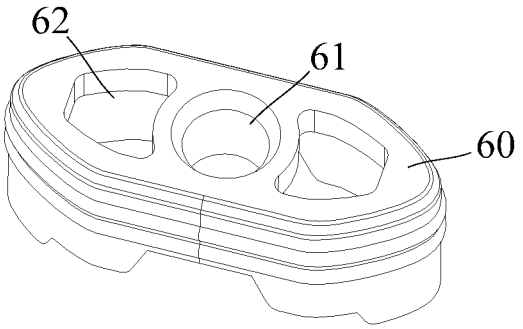
FIG. 7 is a schematic diagram of a silicone sealing base in FIG. 3 from another angle of view.
Figure 8:
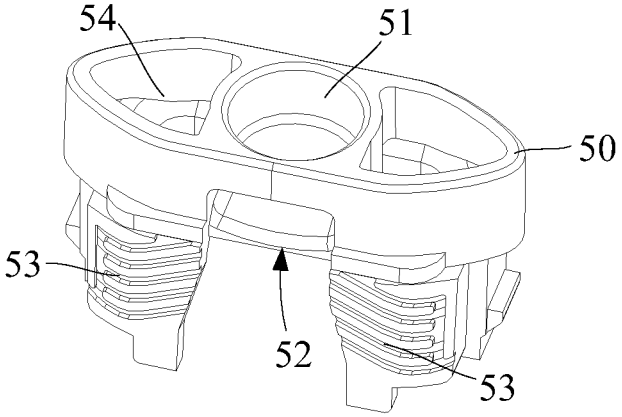
FIG. 8 is a schematic diagram of a support frame in FIG. 3 from another angle of view.
Figure 9:
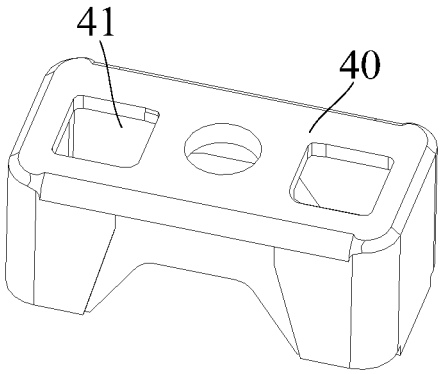
FIG. 9 is a schematic diagram of a silicone sleeve in FIG. 3 from another angle of view.

Further, referring to FIG. 4 to FIG. 6, a support arm 24 extending toward the rigid support frame 50 is further arranged at the end cap 20, and is configured to support the support frame 50 in use, so that the support frame 50 is stably held inside the outer housing 10.

A separating plate 70 is further arranged between the end cap 20 and the vaporization surface of the porous body 31. On the one hand, the separating plate 70 can receive the liquid substrate seeping from the vaporization surface. On the other hand, a through hole 72 for the electrode column 21 to pass through is provided on the separating plate 70, and the electrode column 21 penetrating the end cap 20 and abutting against both ends of the heating element 32 can be held and fixed. As shown in FIG. 5 and FIG. 6, a vent hole 71 is further provided on the separating plate 70, is in airflow communication with the air inlet hole 22, and is used for air to flow through the vaporization surface in a thickness direction in a manner shown in FIG. 5 and then output from the airflow channel 52.

According to a preferred embodiment shown in FIG. 6, the vent hole 71 is provided off-center, in particular close to a side in the thickness direction, and is relatively separated from the heating element 32 of the vaporization surface.

Further, in the embodiments shown in FIG. 3 to FIG. 6, a groove 25 is provided on the end cap 20, and is used for mounting a sealing ring 80 to seal a gap between the end cap 20 and the outer housing 10. During implementation, a vaporization cavity 90 is formed between the sealing ring 80 and the silicone sealing base 60, and the porous body 31 for vaporizing the liquid substrate, the heating element 32, the rigid support frame 50, and the like are accommodated and arranged in the vaporization cavity 90 between the sealing ring 80 and the silicone sealing base 60.

Further, in a preferred embodiment, a first capillary liquid storage groove 23 is provided on a surface 27 of the end cap 20 facing an inner wall of the outer housing 10, and a second capillary liquid storage groove 53 is provided on a surface 56 of a corresponding rigid support frame 50 facing the inner wall of the outer housing 10. Widths of the first capillary liquid storage groove 23 and the second capillary liquid storage groove 53 may be small enough to have capillary adsorbing action on liquid medium, for example, the width may be between 0.05 mm and 0.2 mm, preferably between 0.09 mm and 0.15 mm.

In addition, in the preferred embodiment shown in FIG. 5, there are a plurality of the first capillary liquid storage grooves 23 and the second capillary liquid storage grooves 53. The first capillary liquid storage grooves 23 and the second capillary liquid storage grooves 53 are discrete, i.e. they are not intersected or connected to each other, and discrete arrangement can increase an action area with airflow through capillary adsorbing action.

In the preferred embodiment shown in FIG. 5, the first capillary liquid storage groove 23 extends at least partially on an outer surface of the support arm 24. The second capillary liquid storage groove 53 is provided around both sides of the airflow channel 52 in a width direction and has a more sufficient capillary adsorption effect with condensate of aerosol transmitted in the airflow channel 52. Certainly, spaces of the first capillary liquid storage groove 23 and the second capillary liquid storage groove 53 are in airflow communication with the airflow channel 52.

More preferably, the second capillary liquid storage groove 53 is provided obliquely close to the silicone sealing base 60.

Figure 11:
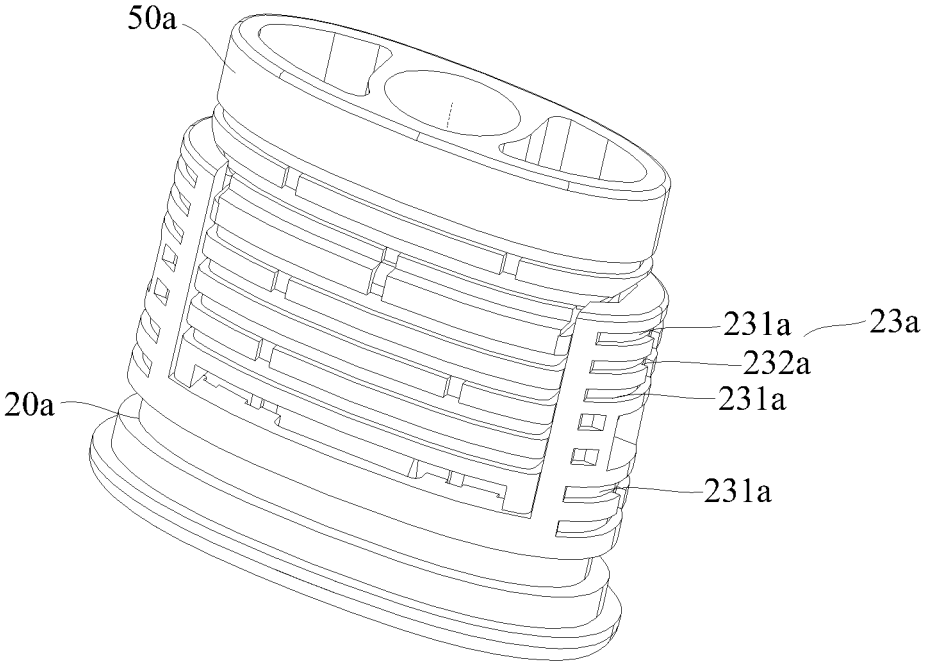
FIG. 11 is a schematic diagram after an end cap and a support frame are assembled according to another embodiment.
Figure 12:
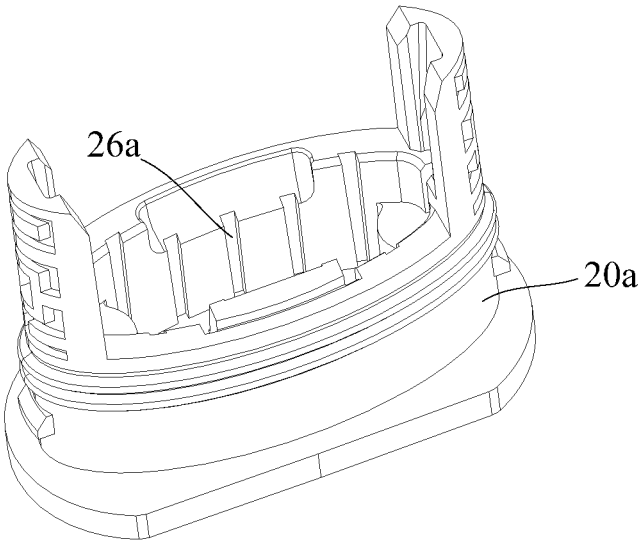
FIG. 12 is a schematic diagram of the end cap in FIG. 11 from another angle of view.
Figure 13:
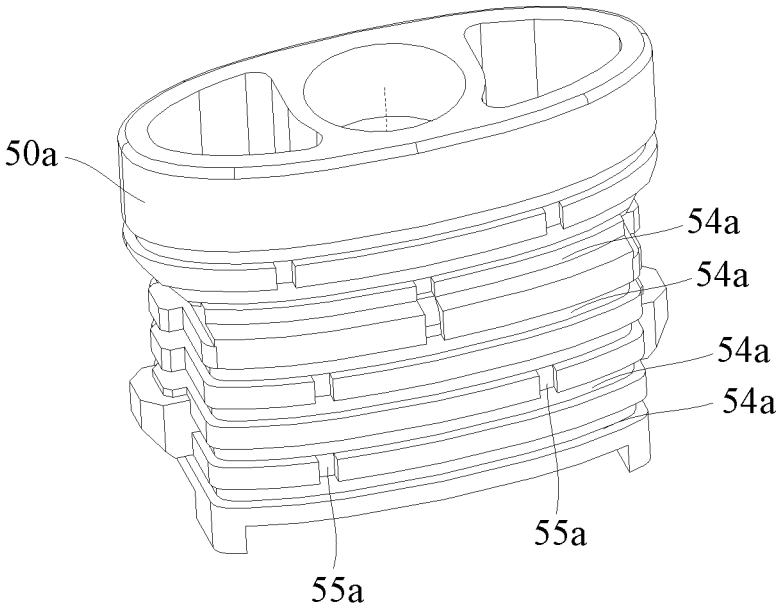
FIG. 13 is a schematic diagram of the support frame in FIG. 11 from another angle of view.

Further, referring to FIG. 11 to FIG. 13, in another variable embodiment, capillary liquid storage grooves provided on an end cap 20*a* and a support frame 50*a* may be in communication with each other. Specifically,

- a third capillary liquid storage groove extending in a circumferential direction is provided on the support frame 50*a*. The support frame 50*a* includes a plurality of first portions 54*a* extending in the circumferential direction of the support frame 50*a*, and a second portion 55*a* connected to the first portion 54*a* in a longitudinal direction, thereby being integrally communicated to form a whole, and having a larger capillary adsorption space or capacity. Alternatively, in another variable embodiment, it may further at least partially surround a circumferential surface of the support frame 50*a*. There may be a plurality of second portions 55*a*, and according to the preferred embodiment shown in the figure, the plurality of second portions 55*a* are relatively separated in a longitudinal direction of the support frame 50*a*, to increase a capability to hold the condensate and reduce its flow between the third capillary liquid storage grooves.

Likewise, a first capillary liquid storage groove 23*a* provided on an outer surface of the end cap 20*a* also includes a plurality of first portions 231*a* extending in a circumferential direction and second portions 232*a* extending in a longitudinal direction that are in communication with each other.

Further, a fourth capillary liquid storage groove 26*a* extending in the longitudinal direction is provided on an inner wall of the end cap 20*a* shown in FIG. 12.

Further, in a more preferred embodiment, the foregoing capillary liquid storage groove is isolated from the liquid storage cavity 12 through the silicone sealing base 60 to maintain non-airflow communication. Specifically, the silicone sealing base 60 may prevent the liquid substrate from flowing out of the liquid storage cavity 12, prevent the liquid substrate from flowing to the first capillary liquid storage groove 23 and the second capillary liquid storage groove 53, and prevent flow of gas or airflow between the liquid storage cavity 12 and the vaporization cavity 90, so that the liquid storage cavity 12 and the vaporization cavity 90, and the first capillary liquid storage groove 23 and the second capillary liquid storage groove 53 are fluidly isolated from each other and in non-airflow communication; and can only allow the gas to enter the liquid storage cavity 12 through a microporous pore of the porous body 31 as a medium channel.

A certain gap is maintained between the outer surface of the end cap 20/20*a* and the outer housing 10, so that the liquid storage groove on the outer surface of the end cap 20/20*a* is in airflow communication with the vaporization cavity 90 or a vapor-gas output channel 91 formed inside the vapor-gas transmission pipe 11, and the condensate in the vaporization cavity 90 can be transmitted to the liquid storage groove on the outer surface of the end cap 20/20*a* through capillary infiltration of the gap. In addition, a small gap may be maintained between the support arm 24 of the end cap 20/20*a* and the support frame 50/50*a*, which can maintain airflow communication in the vaporization cavity 90 and promote infiltration and transmission of the condensate.

The e-cigarette vaporizer uses the liquid storage groove for absorbing the condensate through the capillary action provided on the end cap or the rigid support frame, and prevents the condensate from being taken out along with inhaling airflow during inhaling by keeping the condensate in the liquid storage groove, thus eliminating a problem of inhaling the condensate.

It needs to be noted that, preferred embodiments of this application are described in the specification and the accompanying drawings thereof, but are not limited to the embodiments described herein, further, a person of ordinary skill in the art may make improvements or modifications according to the foregoing description, and all of the improvements and modifications should all fall within the protection scope of the attached claims of this application.

What is claimed is:

1. An electronic cigarette (e-cigarette) vaporizer, comprising an outer housing comprising an open end and an end cap arranged at the open end, and a near end disposed spaced away from the open end for inhaling of an aerosol from the vaporizer, wherein:

a liquid storage cavity configured to store a liquid substrate and a sealing base configured to seal the liquid storage cavity are provided in the outer housing;

a sealing ring is arranged between the end cap and the outer housing;

a vaporization cavity is provided between the sealing ring and the sealing base, a heater is disposed in the vaporization cavity, and the liquid substrate from the liquid storage cavity is vaporized due to heating of the heater in the vaporization cavity to generate the aerosol released to the vaporization cavity; and the aerosol is inhaled at the near end by moving from the vaporization cavity toward the near end, and condensates are condensed from the moving aerosol when the aerosol moves away from heating of the heater toward the near end, a plurality of liquid storage grooves configured to absorb and hold the condensate through capillary action are provided on a surface partially defining and surrounding the vaporization cavity.

2. The e-cigarette vaporizer according to claim 1, wherein a width of each of the plurality of liquid storage grooves is between 0.05 mm and 0.2 mm.

3. The e-cigarette vaporizer according to claim 1, wherein non-airflow communication is maintained between the plurality of liquid storage grooves and the liquid storage cavity.

4. The e-cigarette vaporizer according to claim 1, wherein a vapor-gas output channel is further arranged in the outer housing, and the plurality of liquid storage grooves are in airflow communication with the vapor-gas output channel.

5. The e-cigarette vaporizer according to claim 1, wherein the plurality of liquid storage grooves comprise a first liquid storage groove provided on a surface of the end cap facing an inner wall of the outer housing.

6. The e-cigarette vaporizer according to claim 5, wherein a heating element configured to vaporize the liquid substrate to generate the aerosol and release the aerosol into the vaporization cavity, and a porous body configured to transmit the liquid substrate of the liquid storage cavity to the heating element are arranged in the vaporization cavity;

a support frame configured to accommodate and hold the porous body is further arranged in the vaporization cavity; and a support arm configured to provide support to the support frame is arranged at the end cap, and the first liquid storage groove at least partially extends on a surface of the support arm.

7. The e-cigarette vaporizer according to claim 5, wherein a heating element configured to vaporize the liquid substrate to generate the aerosol and release the aerosol into the vaporization cavity, and a porous body configured to transmit the liquid substrate of the liquid storage cavity to the heating element are arranged in the vaporization cavity;

a support frame configured to accommodate and maintain the porous body is further arranged in the vaporization cavity; and the plurality of liquid storage grooves comprise a second liquid storage groove formed on a surface of the support frame facing an inner wall of the outer housing.

8. The e-cigarette vaporizer according to claim 7, wherein the second liquid storage groove is constructed to be provided obliquely in a direction close to the sealing base.

9. The e-cigarette vaporizer according to claim 7, wherein a vapor-gas output channel is further arranged in the outer housing, and the vapor-gas output channel is at least partially located on the surface of the support frame facing the inner wall of the outer housing; and the second liquid storage groove is constructed to be provided at both sides of the vapor-gas output channel in a width direction of the outer housing.

10. The e-cigarette vaporizer according to claim 7, wherein the second liquid storage groove comprises a first portion extending in a circumferential direction around the support frame and a second portion in communication with the first portion in a longitudinal direction of the support frame.

11. The e-cigarette vaporizer according to claim 10, wherein the second portions are separated from each other in the longitudinal direction of the support frame.

12. The e-cigarette vaporizer according to claim 1, wherein the plurality of the liquid storage grooves are discretely provided without intersecting or connecting with each other.

13. An e-cigarette, comprising a vaporizing device for vaporizing a liquid substrate to generate aerosol, and a power supply device for supplying power to the vaporizing device, wherein the vaporizing device comprises the e-cigarette vaporizer according to claim 1.

14. The e-cigarette vaporizer according to claim 2, wherein the plurality of liquid storage grooves comprise a first liquid storage groove provided on a surface of the end cap facing an inner wall of the outer housing.

15. The e-cigarette vaporizer according to claim 14, wherein a heating element configured to vaporize the liquid substrate to generate the aerosol and release the aerosol into the vaporization cavity, and a porous body configured to transmit the liquid substrate of the liquid storage cavity to the heating element are arranged in the vaporization cavity;

a support frame configured to accommodate and hold the porous body is further arranged in the vaporization cavity; and a support arm configured to provide support to the support frame is arranged at the end cap, and the first liquid storage groove at least partially extends on a surface of the support arm.

16. The e-cigarette vaporizer according to claim 3, wherein the plurality of liquid storage grooves comprise a first liquid storage groove provided on a surface of the end cap facing an inner wall of the outer housing.

17. The e-cigarette vaporizer according to claim 16, wherein a heating element configured to vaporize the liquid substrate to generate the aerosol and release the aerosol into the vaporization cavity, and a porous body configured to transmit the liquid substrate of the liquid storage cavity to the heating element are arranged in the vaporization cavity;

a support frame configured to accommodate and hold the porous body is further arranged in the vaporization cavity; and a support arm configured to provide support to the support frame is arranged at the end cap, and the first liquid storage groove at least partially extends on a surface of the support arm.

18. The e-cigarette vaporizer according to claim 4, wherein the plurality of liquid storage grooves comprise a first liquid storage groove provided on a surface of the end cap facing an inner wall of the outer housing.

19. The e-cigarette vaporizer according to claim 18, wherein a heating element configured to vaporize the liquid substrate to generate the aerosol and release the aerosol into the vaporization cavity, and a porous body configured to transmit the liquid substrate of the liquid storage cavity to the heating element are arranged in the vaporization cavity;

a support frame configured to accommodate and hold the porous body is further arranged in the vaporization cavity; and a support arm configured to provide support to the support frame is arranged at the end cap, and the first liquid storage groove at least partially extends on a surface of the support arm.

* * * * *